United States Patent [19]

Cressman et al.

[11] Patent Number: 5,022,159

[45] Date of Patent: Jun. 11, 1991

[54] HAND-HELD CAN OPENER

[75] Inventors: Christopher C. Cressman; David A. Holcomb, both of Seattle, Wash.

[73] Assignee: Chef'N Corporation, Seattle, Wash.

[21] Appl. No.: 443,487

[22] Filed: Nov. 29, 1989

[51] Int. Cl.[5] ..... B67B 7/46

[52] U.S. Cl. ..... 30/418; 30/400; 30/409; 30/410

[58] Field of Search ..... 30/400, 401, 402, 403, 30/404, 405, 406, 407, 408, 409, 410, 418, 443

[56] References Cited

U.S. PATENT DOCUMENTS 1,364,016 12/1920 Worthington ..... 30/409
4,186,485 2/1980 Bainton et al. ..... 30/410

FOREIGN PATENT DOCUMENTS 7312878 7/1986 China .
7510198 5/1989 China .
7510458 7/1989 China .
7328346 3/1985 Japan .
7420634 4/1986 Japan .
2161449 1/1986 United Kingdom ..... 30/400

*Primary Examiner*—Douglas D. Watts
*Assistant Examiner*—Paul M. Heyrana, Sr.
*Attorney, Agent, or Firm*—Seed and Berry

[57] ABSTRACT

A hand-held can opener is provided with a grip handle, a grip block pivotally mounted to the forward end of the grip handle, a scissor handle pivotally mounted to the grip block and having a one way roller clutch connection with a unidirectionally driven feed wheel. The grip block is provided with a latch. Squeezing of the scissor handle toward the grip handle with pivot the grip block to position the feed wheel relative to the cutter for penetration of the can lid and lock the grip block into this position. Subsequent release and squeezing of the scissor handle will drive the feed wheel undirectionally for advancing the can lid past the cutter.

18 Claims, 1 Drawing Sheet

HAND-HELD CAN OPENER

DESCRIPTION

1. Background of the Invention

This invention pertains to hand-held can openers of the type having a squeeze-type action to latch onto and pierce the can and subsequently rotate the can past the cutter.

Hand-held can openers of this type have frequently employed one hand for squeezing the handles together and a second hand for rotating a feed wheel to advance the can past the cutter. More complex can openers of the hand-held type have employed mechanisms in which the handles can be brought together to latch the can rim into its cutting position relative to the cutter and subsequently maintain that latched condition while the handles can separate and advance the feed wheel in a scissor action. U.S. Pat. No. 2,718,056 is an example of this latter type of can opener. The can opener in this patent, however, requires an awkward over center latching mechanism and numerous linkages making the can opener difficult to use and expensive to manufacture. U.S. Pat. No. 2,924,878 shows an additional hand-held can opener where a separate latching member holds the cutter in operative position relative to the feed wheel and the lower gripping portion of the handle is reciprocated relative to the upper portion for advancing the feed wheel.

SUMMARY OF THE INVENTION

It is an object of this invention to provide a hand-held can opener which more effectively latches the feed wheel relative to the cutter and enables the cutter to pierce the can lid.

It is another object of this invention to provide a hand-held can opener which is less expensive to manufacture and easy to use.

Basically, these objects are obtained by a can opener having a grip handle and a scissor handle. A grip block is pivotally mounted at its forward end to a forward end of the grip handle. The scissor handle is pivotally mounted on the grip block. By swinging the scissor handle up against the grip block, the grip block is pivoted into a latching position with the cutter on the grip handle piercing the can lid and the grip block maintaining the feed wheel in its proper spaced relationship with the cutter and a set of wear rods for advancing the rim of the can past the cutter. The scissor handle is then separately movable relative to the grip block and the grip handle and drives a one-way clutch to advance the feed wheel.

In the preferred embodiment, the latch mechanism for holding the grip block against the grip handle and holding the can rim between the feed wheel and the cutter is engaged readily by the thumb of the user's hand to release the can opener from the can. Thus one hand is free to manipulate the can while the other holds the can opener.

The arrangement of the components of the opener is advantageously suited to provide maximum leverage for bringing the feed wheel and cutter into position relative to one another for piercing the can. The simplicity and relatively few number of components makes the can opener less expensive to manufacture and easier to use.

DETAILED DESCRIPTION OF THE INVENTION

Figure 1:
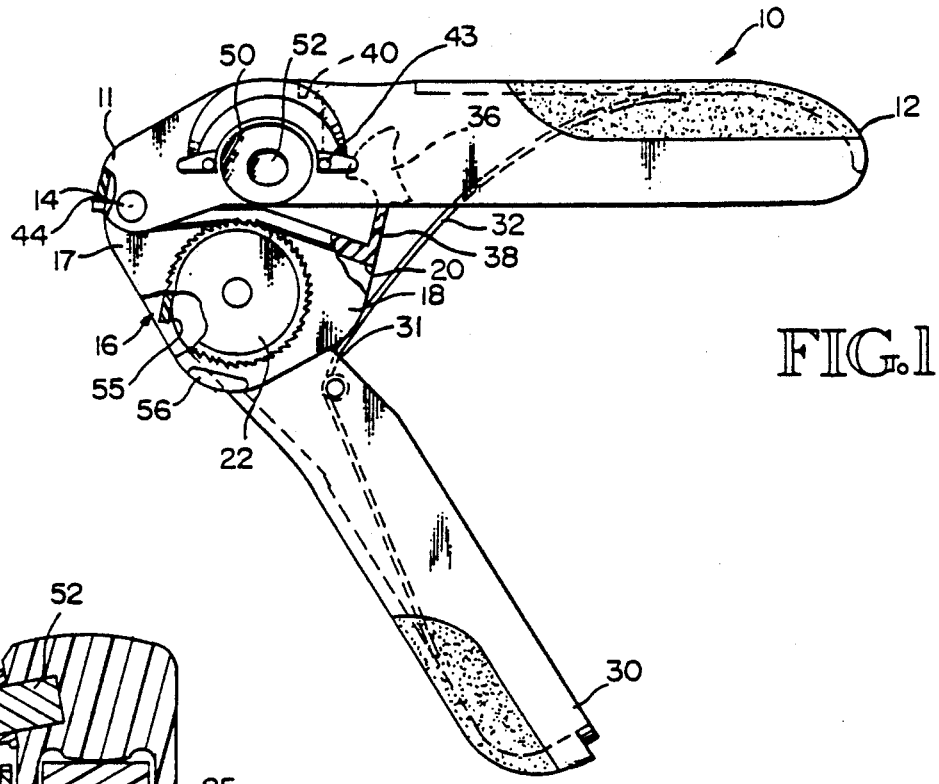
FIG. 1 is a side elevation of the can opener embodying the principles of the invention.
Figure 3:
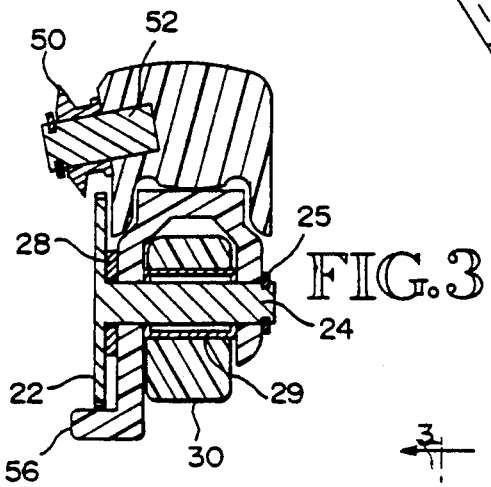
FIG. 3 is a section taken along the line 3—3 of FIG. 2.

As best shown in FIG. 1, the can opener has a hollow grip handle 10 having a forward end 11 and a rearward end 12. Pivotally mounted on a pivot post 14 is a grip block 16. The grip block is pivoted at its forward end 17 and is provided with a rearward end 18 with an abutment surface 20.

Pivotally mounted to the grip block is a feed wheel 22 of the conventional serrated periphery type. The feed wheel is fixed to a feed wheel axle 24 which is pivotally retained on the grip block 16 by a conventional retainer 25 or other suitable fastener. A spacer 28 positions the feed wheel relative to the grip block.

Pivotally mounted to the feed wheel axle 24 by a conventional, one-way or unidirectional roller clutch 29, such as a Torrington Company overrunning roller clutch, is a hollow scissor handle 30. The roller clutch is well known in other uses, but is unique in this hand-held can opener application. The roller clutch advantageously offers simplicity and reliability in this small hand-held opener use. With the roller clutch, pivotal movement of scissor handle 30 towards grip handle 10, will rotate the feed wheel 22 to advance a can rim of a can "c," but with movement of the scissor handle away from the grip handle will allow free rotation between the scissor handle and the feed wheel, thus producing unidirectional movement of the feed wheel. A return spring 32 maintains the handles in separated position.

Figure 2:
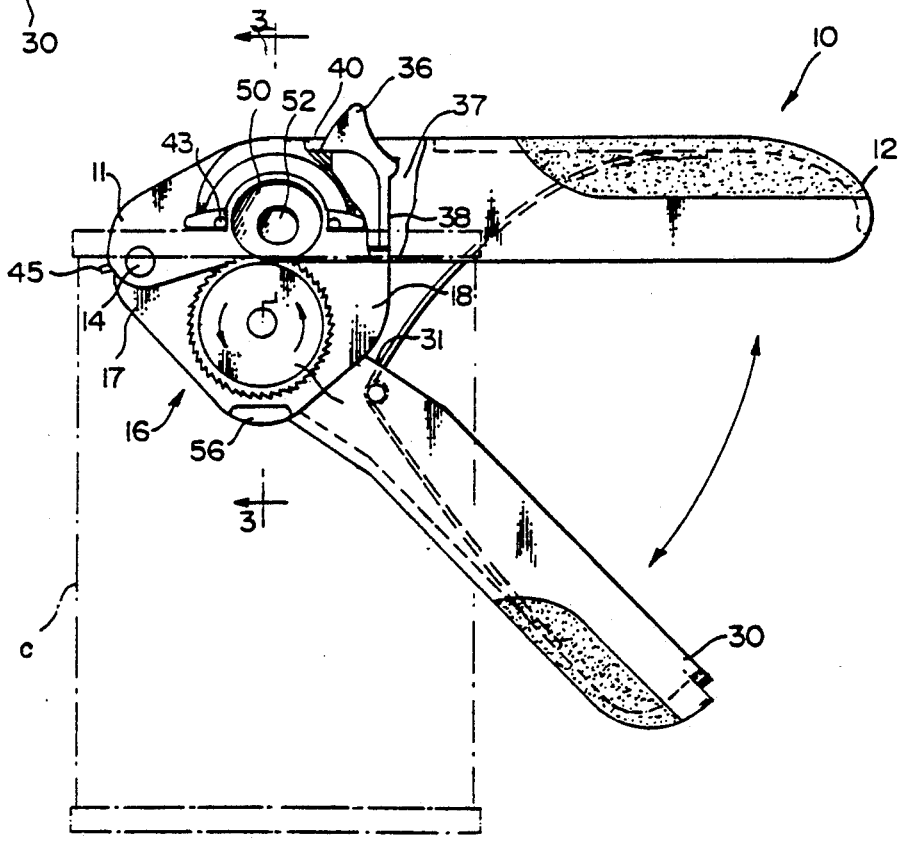
FIG. 2 is a side elevation of the can opener in a second operative position.

The scissor handle 30 is provided with a bumper surface 31 which engages the abutment surface 20 to pivot the grip block counterclockwise toward the grip handle. The grip block is provided with a latch 36 mounted on an elastic latch post 38 that is fixed to the grip block. The latch passes through an opening 37 in the grip handle and engages with a keeper 40 molded into the grip handle. As the scissor handle pivots the grip block counterclockwise from the position shown in FIG. 1 to the position shown in FIG. 2, the latch rides over the latch keeper and latches the grip block in the position shown in FIG. 2. Upon release of the latch 36, the spring 32 separates the handles sufficiently that the scissor handle engages the inside surface 55 on the grip block and pushes the grip block clockwise to open the space between the feed wheel and the cutter. As is apparent, the latch 36 is readily accessible by the thumb of the user gripping the handles so that release of the can is readily accomplished with the same hand as was operating the scissor and grip handles.

A circular cutter 50 is freely pivotally mounted on a cutter post 52 that is fixed to the grip handle. When the grip block is pivoted into its latch position, the feed wheel is positioned relative to the cutter to force the cutter to pierce the lid of the can. The rim is squeezed between steel wear rods 43 and the feed wheel 22 positioning the rim and advancing the lid of the can past the cutter. The unique use of the unilateral clutch in this combination of handles and grip block, simplifies the unidirectional driving motion of the feed wheel. Furthermore, by pivoting the grip block at the forward end of the grip handle, considerable leverage can be brought to bear to pivot the grip block toward the grip handle. This facilitates the piercing of the can lid by the cutter and provides considerable gripping force for the feed wheel against the rim of the can. A spacer post 56 is provided on the lower end of the grip block for positioning the side wall of the can relative to the cutter and feed wheel while the can is being rotated.

As illustrated in the drawings, in a preferred embodiment of the invention, the diameter of the feed wheel should be large and is approximately twice the diameter of the cutter so as to maximize the amount of rotation of the can for each stroke of the scissor handle.

In operation the latch 36 is released allowing the spring 32 to pivot the grip block clockwise to separate the feed wheel from the cutter. The feed wheel is then positioned beneath the rim of the can and the scissor handle and grip handle brought together to swing the grip block counterclockwise by the bumper surface 31 pushing against the abutment surface 20. The can is then urged by the feed wheel toward the cutter until penetration of the can lid occurs and the rim of the can abuts the wear rods 43. At this time the latch 36 will automatically slide over the keeper 40 holding the can rim tightly between the feed wheel and the wear rods with the cutter penetrating the can lid. As the scissor handle is then released, the return spring 32 separates the handles. Subsequent squeezing of the scissor handle will unidirectionally rotate the feed wheel through the one-way clutch. When the can lid has been completely severed, the latch 36 is moved rearwardly and the can is released as the grip block pivots clockwise to separate the feed wheel from the cutter.

While the preferred embodiments of the invention have been illustrated and described, it should be understood that the components lend themselves well to fabrication by use of molded plastic materials. Other variations will be apparent to those skilled in the art, however, and the invention is not to be limited to the specific embodiment illustrated in the drawing.

We claim:

1. A hand-held can opener, comprising:

a scissor handle;

a grip block, said scissor handle being pivotally mounted on said grip block, said grip block having a can rim feed wheel and a latch;

a one-way clutch connected between the feed wheel and the scissor handle for rotating the feed wheel in one direction only with each pivotal swing of the scissor handle;

a grip handle pivotally secured to the grip block but not to the scissor handle and having a freely rotatable cutter and a keeper releasably lockingly engageable by said latch for locking the feed wheel adjacent to the cutter; and a return spring for separating the scissor handle and the grip handle for allowing oscillation of the pivotal movement of the scissor handle by a repetitive squeezing motion.

2. The can opener of claim 1, said grip block having an abutment surface, said scissor handle having a bumper surface engaged with said grip block abutment surface for pivoting the grip block toward the grip handle to force the feed wheel against the underside of a can rim to push the lid of the can into penetration by the cutter, and for engaging the latch on the keeper to hold the feed wheel and cutter in position on the can rim and can lid respectively.

3. The can opener of claim 2, the grip handle having an opening, the latch extending through said opening when the latch is engaged by the keeper and being accessible for releasing the latch and thus the grip block with the same hand as is holding the grip handle and scissor handle.

4. The can opener of claim 2, including wear rods on the grip handle adjacent the cutter for positioning and gripping the can rim, said return spring having sufficient reach to separate the scissor handle from the grip handle beyond the latched position of the grip block, the scissor handle pivoting the grip block to separate the cutter from the feed wheel when the latch is released.

5. The can opener of claim 4, the grip handle having an opening, the latch extending through the opening when the latch is engaged by the keeper and being accessible for releasing the latch and thus the grip block with the same hand as is holding the grip handle and scissor handle.

6. The can opener of claim 5, said one-way clutch being a roller clutch.

7. The can opener of claim 1, the grip handle having an opening, the latch extending through the opening when the latch is engaged by the keeper and being accessible for releasing the latch and thus the grip block with the same hand as is holding the grip handle and scissor handle.

8. The can opener of claim 1, said return spring having sufficient reach to separate the scissor handle from the grip handle beyond the latched position of the grip block, the scissor handle pivoting the grip block to separate the cutter from the feed wheel when the latch is released.

9. The can opener of claim 1, said one-way clutch being a roller clutch.

10. The can opener of claim 1 wherein the diameter of said feed wheel is substantially larger than the diameter of said cutter so as to maximize the amount of rotation of said can for each stroke of said scissor handle.

11. The can opener of claim 1, wherein the diameter of the feed wheel is approximately twice the diameter of the cutter.

12. The can opener of claim 1 wherein said scissor handle and said grip handle are pivotally secured at respective ends thereof to said grip block, the opposite ends thereof being adapted to be pivoted towards and away from each other in a scissor-like manner and wherein said feed wheel and said cutter are disposed on the same side of the pivot point of said grip handle and said grip block as said opposite ends of said scissor handle and said grip handle and more closely spaced toward the pivot point of said grip handle and grip block than to the opposite ends of the grip and scissor handles so as to provide leverage for a user to cause said cutter to penetrate said can by squeezing said opposite ends of said scissor handle and said grip handle together.

13. The can opener of claim 1, wherein said one-way clutch is an overrunning unidirectional roller clutch for assuring positive infinitely engageable driving torque to the feed wheel.

14. A hand-held can opener having a first handle having forward and rearward ends, can rim gripping means having forward and rearward ends with the forward end being pivotally mounted on the forward end of the first handle;

a second handle having forward and rearward ends with said forward end being pivotally mounted on the can rim gripping means;

abutment means on the second handle engaged with the can rim gripping means for pivoting the gripping means into a can rim gripping position on said first handle, said gripping means including a unidirectionally driven feed wheel and said first handle having a cutter, latch means on said gripping means for holding the gripping means onto the first handle with the feed wheel and cutter operatively overlapping in a can lid cutting position whereby initially pivoting the second handle toward the first handle will swing the gripping means into a releasably latched can rim gripping and can lid cutting position, while subsequent pivoting cycles of the second handle will rotate the can feed wheel unidirectionally to advance the can past the cutter.

15. The can opener of claim 14, said gripping means including a grip block having forward and rearward ends with a forward end pivotally attached to the first handle, said latching means including an elastic latch post secured to a rear end of the grip block and terminating in a latch member, said first handle having a keeper for releasably securing the latch member when the grip block is pivoted against the first handle.

16. The can opener of claim 15, said grip block having a surface engageable by the second handle when the latch means is released for separating the grip block from the first handle when the latch member is released, and including a return spring for separating the handles.

17. The can opener of claim 16, said unidirectionally driven feed wheel including a one-way roller clutch.

18. The can opener of claim 14, said unidirectionally driven feed wheel including a one-way roller clutch.

* * * * *